US005520469A

United States Patent [19]

Owa

[11] Patent Number: 5,520,469

[45] Date of Patent: May 28, 1996

[54] DOT MATRIX PRINTER

[75] Inventor: Kenichi Owa, Ebina, Japan

[73] Assignee: Fuji Xerox Co., Ltd., Tokyo, Japan

[21] Appl. No.: 111,567

[22] Filed: Aug. 25, 1993

[30] Foreign Application Priority Data

Sep. 2, 1992 [JP] Japan ..... 4-259064

[51] Int. Cl.[6] ..... B41J 19/58

[52] U.S. Cl. ..... 400/76; 400/279; 400/555; 395/108

[58] Field of Search ..... 400/555, 568, 400/582, 279, 320, 323, 61, 76; 395/111, 108

[56] References Cited

U.S. PATENT DOCUMENTS 4,761,085 8/1988 Angst ..... 400/323

5,033,880 7/1991 Kageyama et al. ..... 400/555

FOREIGN PATENT DOCUMENTS 3-47766 2/1991 Japan ..... 400/555

*Primary Examiner*—Edgar S. Burr

*Assistant Examiner*—Steven S. Kelley

*Attorney, Agent, or Firm*—Oliff & Berridge

[57] ABSTRACT

Disclosed herein is a dot matrix printer capable of recording character strings with a high quality at high speeds. The dot matrix printer includes an output processor for obtaining the numbers of effective dots of character patterns in a character string with respect to a character string reference line designating a print position of font of the character string according to information of the font and information of the character string reference line, comparing the numbers of effective dots with the number of printable dots of the print head, determining whether or not another character string in addition to the character string is admitted within the width of the print head if a maximum value of the numbers of effective dots is smaller than the width of the print head, and setting a print position of at least one of the character strings admitted within the width of the print head.

6 Claims, 6 Drawing Sheets

DOT MATRIX PRINTER

BACKGROUND OF THE INVENTION

1. Field of the Invention

The present invention relates to a dot matrix printer for effecting printing of an image on a printing medium according to print data received, by scanning a print head.

2. Description of the Related Art

The recent spread of desktop publishing has increased the needs to be met by high-functional printers to cope with a variety of fonts to be used and print formats. Some of page printers such as laser printers meeting the above needs have been developed. In general, however, the page printers are expensive, and so inexpensive high-functional printers are desired. As a kind of such inexpensive high-functional printers such as ink jet printers have remarkably been improved in print quality and density, and some of them having a print quality equal to or higher than that of the page printers have been developed. In view of such a trend, the development of the function to enable the use of several kinds of fonts and the printing with various formats is now necessary in not only the page printers but also the dot matrix printers.

The printing by such dot matrix printers is carried out in the following manner. That is, a character pattern corresponding to a character code transmitted from a host computer is read from a ROM previously storing it, and the character pattern is stored as a dot matrix image pattern into a buffer. Then, the dot matrix image pattern stored in the buffer is read to be applied to a print head, and is printed on a printing medium by the print head. The print head is mounted on a carriage. The carriage is moved in a direction perpendicular to a feed direction of the printing medium, thereby printing an image in a belt-shaped print area. After the printing of the image in the print area is ended, the printing medium is fed by a motor or the like.

FIGS. 5A and 5B illustrate print examples in the prior art printers. A print width in a dot matrix printer as mentioned above usually corresponds to a width of a print head. Accordingly, the simplest printing method in printing an image of one page is to feed a printing medium by the print width after printing one print area and then repeat this operation to obtain a continuous print of the image on the page. In the case of printing character strings at a line pitch larger than the width of the print area as shown in FIG. 5A, there is a possibility that some of the character strings printed lie on a boundary of adjacent print areas with a feed quantity of the printing medium being fixed, causing slippage of the printed image. More specifically, the character string "Mt. Fuji" on the second line is divided by the boundary between the second print area and the third print area. The upper and lower print areas adjacent to each other cannot be accurately jointed together along the boundary because of a problem in accuracy of the feed motor in feeding the printing medium and an influence of slip or play between the printing medium and a feed system, resulting in a slight gap or overlap between the adjacent print areas. Such a gap or overlap causes a reduction in quality of the printed image.

This problem is solved by skipping a blank portion between print lines in many printers and work processors. For example, as shown in FIG. 5B, the printing medium is fed by a quantity corresponding to a width of a blank portion between the adjacent character strings. As a result, the character string "Mt. Fuji" on the second line is not divided into two portions to be printed in the second and third print areas as in FIG. 5A, but is fully admitted within one print area.

FIGS. 6A to 6D are diagrams illustrating other print examples in the prior art printer, wherein two character strings each having a width smaller than the width of the print head (i.e., the print width) exist in one print area without vertically overlapping; and FIGS. 7A to 7D are diagrams illustrating still other print examples in the prior art printer, wherein two character strings including heading characters or script characters each having a width smaller than the print width exist in one print area with these strings being horizontally shifted and vertically overlapped at different horizontal print positions.

The printing method wherein an image pattern is printed per print area with a fixed feed quantity is not considered. In the case where two character strings are fully admitted within one print area as shown in FIGS. 6D and 7D, the two character strings can be printed without a cut by a single printing operation in the print area. To the contrary, in the case where two character strings are not fully admitted within one print area, but a part of any character, e.g., a lower part of a character "p" in the character string "Japan" projects out of the print area as shown in FIGS. 6A and 7A, the two character strings cannot be printed by a single printing operation in the print area, but the lower projecting part of the character only will be printed in the next printing operation in the next print area. As a result, slippage of the printed image as mentioned previously will occur.

Next, the printing method wherein character strings are printed per print line is considered. In the case of printing the two character strings as shown in FIGS. 6A and 7A, the upper character string "USA" is first printed as shown in FIGS. 6B and 7B. Then, the printing medium is fed by a quantity corresponding to a difference between a reference line for the upper character string and a reference line for the lower character string, and the lower character string "Japan" is then printed as shown in FIGS. 6C and 7C. According to this method, each character string is not divided in printing, and therefore no slippage of the printed image will occur. However, different print areas must be set according to different reference lines in printing. Accordingly, even when two character strings are fully admitted within one print area as shown in FIGS. 6D and 7D, the printing operation for one print area must be doubled, causing a reduction in print speed.

As another technique different from the above techniques, there is described in Japanese Patent Laid-open Publication No. 3-47766, for example, a printing method by scanning plural times in printing characters larger in height than the width of the print head. When any character in a character string has a height larger than the width of the print head, the print head must be scanned plural times in printing the character string. However, when the height of each character in the character string is not larger than the width of the print head, a single scanning of the print head is preferred to improve a print quality.

SUMMARY OF THE INVENTION

It is accordingly an object of the present invention to provide a dot matrix printer which can record character strings with a high quality at high speeds.

According to the present invention, there is provided a dot matrix printer for effecting printing on a printing medium per a width of a print head according to print data received, comprising moving means for relatively moving said printing medium and said print head; output processing means for obtaining the numbers of effective dots of character patterns in a character string with respect to a character string reference line designating a print position of font of said character string according to information of said font and information of said character string reference line, comparing the numbers of effective dots with the number of printable dots of said print head, determining whether or not another character string in addition to said character string is admitted within the width of said print head if a maximum value of the numbers of effective dots is smaller than the width of said print head, and setting a print position of at least one of said character strings admitted within the width of said print head; and control means for controlling said moving means and said output processing means so that said character strings are output from said output processing means to said print head and that said printing medium and said print head are relatively moved to effect printing of said character strings.

When the height of each character string is not greater than the width of the print head, the character strings are printed per the width of the print head, so that each character string is prevented from being divided by the boundary of a print area, thereby obtaining a printed image having a high quality. Further, when a plurality of character strings arranged along different reference lines are admitted within one print area, the character strings are printed by a single scan of the print head, thereby effecting printing at high speeds. Further, as the numbers of effective dots of character patterns and a feed quantity of the printing medium are automatically decided according to the information of font to be printed, the dot matrix printer according to the present invention can be applied to printing in documents having various formats with use of various fonts.

Other objects and features of the invention will be more fully understood from the following detailed description and appended claims when taken with the accompanying drawings.

DETAILED DESCRIPTION OF THE PREFERRED EMBODIMENTS

Figure 1:
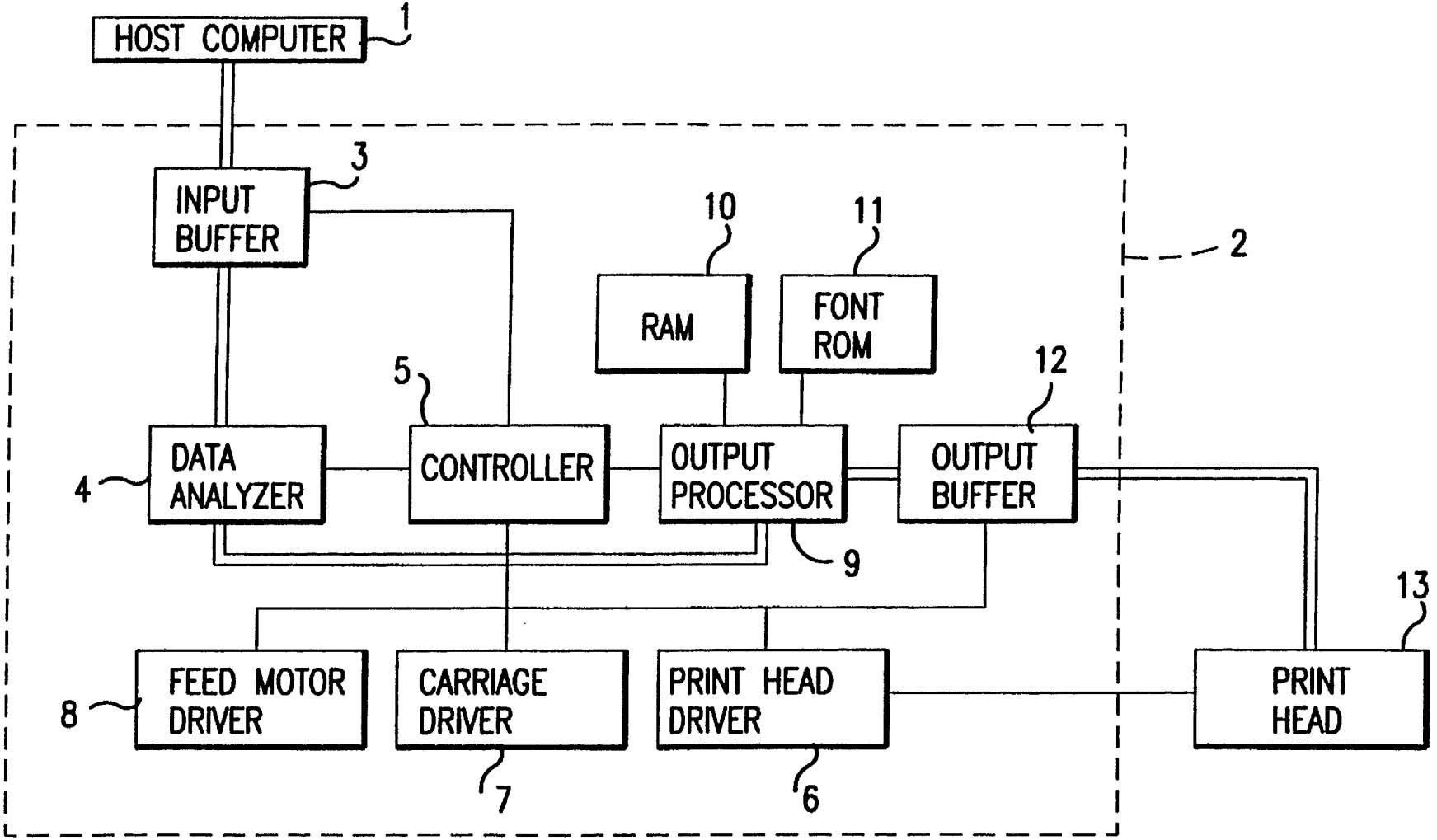
FIG. 1 is a block diagram of a dot matrix printer according to a preferred embodiment of the present invention.

Referring now to FIG. 1, a host computer 1 is connected to a control circuit 2 provided in a dot matrix printer according to a preferred embodiment of the present invention. The control circuit 2 includes an input buffer 3, a data analyzer 4, a controller 5, a print head driver 6, a carriage driver 7, a feed motor driver 8, an output processor 9, a RAM 10, a font ROM 11, and an output buffer 12. A print head 13 is connected to the print head driver 6, and is driven by the same. In FIG. 1, a double line shows a flow of print data.

The host computer 1 is an external equipment for transmitting to the printer the print data including character string information, image information, line information, etc. The control circuit 2 receives the print data from the host computer 1, converts it into image data, transmits the image data to the print head 13, and conducts general control of the printer.

More specifically, the host computer 1 is connected to the input buffer 3. The input buffer 3 is connected to the data analyzer 4 and the controller 5 to temporarily store the print data transmitted from the host computer 1. The data analyzer 4 is connected to the output processor 9 and the controller 5 to analyze the print data stored in the input buffer 3 in accordance with a certain rule. The analysis performed in the data analyzer 4 includes extraction of character strings arranged along a reference line as output objects and format conversion into output objects including print start position information, font information, etc. The analysis also includes rearrangement of output objects in the order of print positions as a processing before comparison of print positions to be carried out in the output processor 9. In the case where such analyzed print data is transmitted from the host computer 1, however, the data analyzer 4 is not necessary.

The controller 5 is connected to each element in the control circuit 2 to generally control the printer. That is, the controller 5 controls driving of the print head driver 6, the carriage driver 7 and the feed motor driver 8, controls reading of data from the input buffer 3 and writing of data to the output buffer 12, and controls processing of the data analyzer 4 and the output processor 9. Although not shown, an input interface or the like may be controlled by the controller 5. The print head driver 6 is connected to the controller 5 and the print head 13 to drive the print head 13 with a print timing controlled by the controller 5 and perform printing of dot matrix data by the print head 13 on a printing medium. The carriage driver 7 is connected to the controller 5 and a carriage motor (not shown) for moving a carriage (not shown) on which the print head 13 is mounted to drive the carriage motor under the control of the controller 5 and perform printing in one print area per scan. The feed motor driver 8 is connected to the controller 5 and a feed motor (not shown) for feeding a printing medium to drive the feed motor under the control of the controller 5 and feed the printing medium. Alternatively, the carriage may be moved rather than feeding of the printing medium.

The output processor 9 is connected to the controller 5, the data analyzer 4, the output buffer 12, the RAM 10 and the font ROM 11 to convert an output object from the data analyzer 4 into dot matrix data, set a print position according to a position information, and store the dot matrix data into the output buffer 12 by using the RAM 10 and the font ROM 11 under the control of the controller 5. The RAM 10 is used as a work memory for temporarily storing an output object, a computation result obtained in the output processor 9. The font ROM 11 previously stores various dot matrix character patterns, size information, position information, etc. The font ROM 11 functions to receive character codes in an output object from the output processor 9 and output character patterns, size information and position information corresponding to the character codes to the output processor 9. The output buffer 12 is connected to the controller 5 to receive dot matrix data from the output processor 9 and output the dot matrix data to the print head 13 under the control of the controller 5.

The print head 13 is connected to the print head driver 6 and the output buffer 12 to print dot matrix data output from the output buffer 12 on a printing medium under the control of the print head driver 6.

Figure 2:
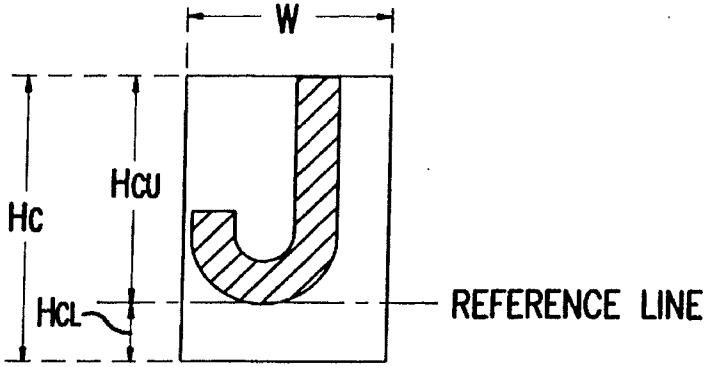
FIG. 2 is a diagram illustrating an example of character information stored in a font ROM shown in FIG. 1.

FIG. 2 illustrates a piece of character information relating to a capital letter "J" as an example, which is one of various characters stored in the font ROM 11. The character information is dot matrix information of a character corresponding to a character code, which includes a character pattern, an upper height $H_{CU}$ of the character pattern, i.e., a distance from a reference line to an uppermost end of the character pattern, a lower height $H_{CL}$ of the character pattern, i.e., a distance from the reference line to a lowermost end of the character pattern, a width W of the character pattern, etc. The character information may further include information of a horizontal reference position of the character pattern. A full height $H_C$ of the character pattern can be given by obtaining the sum of the upper height $H_{CU}$ and the lower height $H_{CL}$. The reference line defines a vertical reference position for aligning characters in forming a character string or one print line. Character codes are expanded to character patterns vertically positioned so that the characters in the character string may be aligned along the reference line. Each character pattern may be defined as dot matrix data including at least all dots to be printed. That is, while there is shown in FIG. 2 a blank space surrounding the letter "J" in the character pattern, the blank space may be removed in storing the character pattern in the font ROM 11, so as to save the storage capacity of the font ROM 11. Printing of different sizes and different print positions of various characters such as the capital letter "J" shown in FIG. 2 and small letters "a" and "p" may be controlled by using the information of the upper height $H_{CU}$, the lower height $H_{CL}$, etc. Further, proportional printing may be performed by setting the widths W of different characters to optimum values and using such proportional-pitch character patterns.

The font ROM 11 may previously store font information including various sizes and styles of fonts. A desired size and style of font may be designated in the print data to be transmitted from the host computer 1, or may be designated by operating an operation panel provided on the printer. In the case of no designation, a default size and style of font may be selected. Further, one or several kinds of font information may be stored in the font ROM 11, and the given font may be converted into a desired font by processing enlargement, reduction, italicization, etc. according to a desired size and style. In this case, the information of the upper height $H_{CU}$, the lower height $H_{CL}$ and the width W must be calculated according to the desired size and style of font.

The font ROM 11 may previously store outline font information. In this case, outline data must be converted into dot matrix data according to a desired size of font to be printed. Furthermore, the information of the upper height $H_{CU}$, the lower height $H_{CL}$ and the width W must also be calculated according to the desired size of font.

Now, the operation of the dot matrix printer according to the preferred embodiment will be described.

The print data transmitted from the host computer 1 is temporarily stored into the input buffer 3. When the print data is stored into the input buffer 3, the controller 5 generates an interrupt to call the data analyzer 4. Then, the data analyzer 4 starts reading the print data from the input buffer 3, and analyzes the print data in accordance with a certain rule to perform extraction of output objects, format conversion, and rearrangement of the output objects in the order of print positions. The output processor 9 receives the output objects from the data analyzer 4. When the output objects are character information, they are collectively arranged per a reference line. The output processor 9 reads character information relating to the characters aligned along the same reference line from the font ROM 11 with reference to the corresponding character codes, converts the output objects into dot matrix data, sets print positions of the dot matrix data according to position information, and stores the dot matrix data into the output buffer 12. The processing of setting the print positions will be hereinafter described in detail. The dot matrix data stored into the output buffer 12 is then output to the print head 13. The controller 5 controls a print timing of the print head driver 6 to actuate the print head 13 and simultaneously controls the carriage driver 7 to move or scan the carriage, thereby effecting printing of the dot matrix data in a one-line print area on a printing medium. After the scanning of the carriage of one line is ended, the controller 5 controls the feed motor driver 8 to drive the feed motor and feed the printing medium by a proper quantity. Thus, a desired image can be recorded on the printing medium by the combination of the scanning of the carriage and the feeding of the printing medium.

Figure 3:
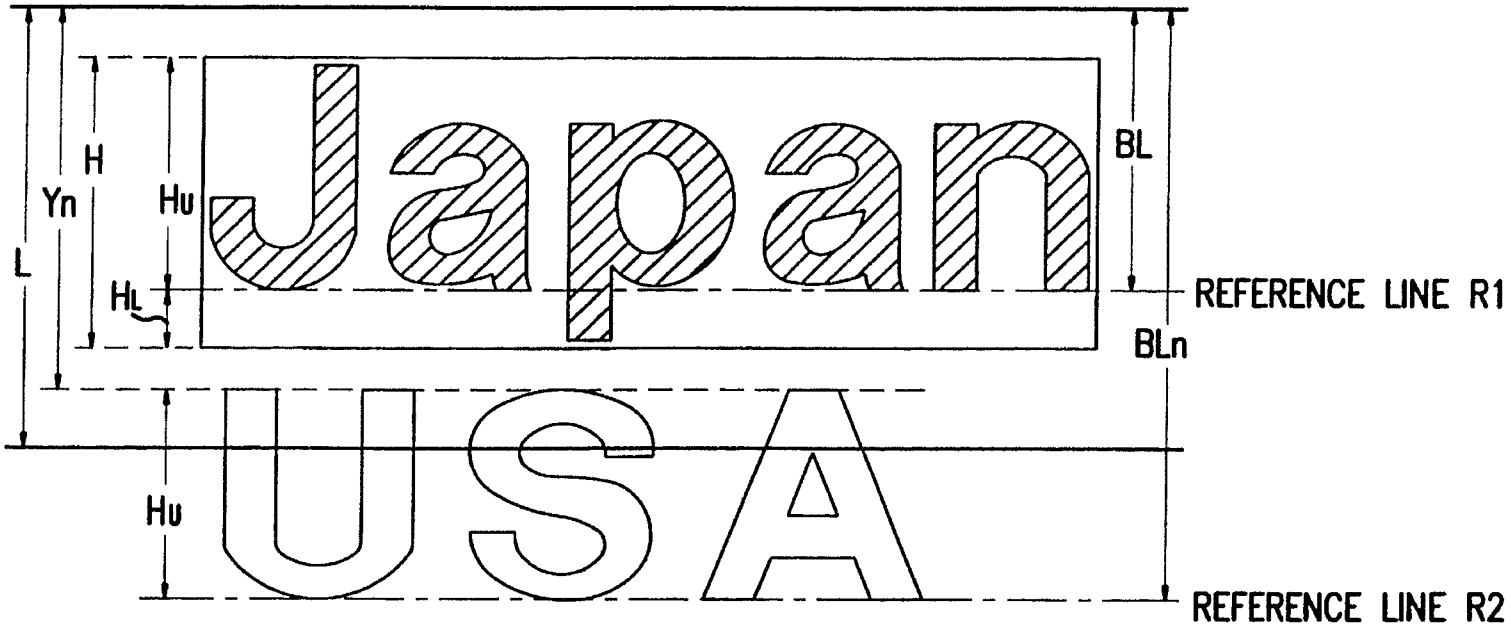
FIG. 3 is a diagram illustrating an example of output objects in relation to a print area.

Prior to description of the processing of comparatively setting the print positions to be carried out in the output processor 9, the relationship between the output objects and the print area will now be described. FIG. 3 illustrates a case where two output objects including character information exist. A reference line R1 defines position information in the first output object including a character string "Japan". A reference line R2 defines position information in the second output object including a character string "USA". The print area is defined between two parallel heavy lines, and it has a width L. The width L is decided on the basis of a print width of the print head 13. That is, the width L is defined as a vertical distance such that the print head 13 can print in the scanning of the carriage by one line. A distance BL is defined as a distance from the upper boundary of the current print area to the reference line R1 for the first output object, and a distance $BL_n$ is defined as a distance from the upper boundary of the current print area to the reference line R2 for the second output object. Further, an upper height $H_U$, a lower height $H_L$ and a full height H of the character string correspond to the upper height $H_{CU}$, the lower height $H_{CL}$ and the full height $H_C$ of the character pattern shown in FIG. 2, respectively. In the case where the values $H_{CU}$ and $H_{CL}$ of one character in the character string are not equal to those of another character in the character string, the maximums of $H_U$ and $H_L$ of all the characters in the character string are set as the values of $H_U$ and $H_L$ of the character string. A distance $Y_n$ is defined as a distance from the upper boundary of the current print area to the upper boundary of the next print area. On the basis of these values, the output processor 9 performs comparative setting of print positions.

Figure 4:
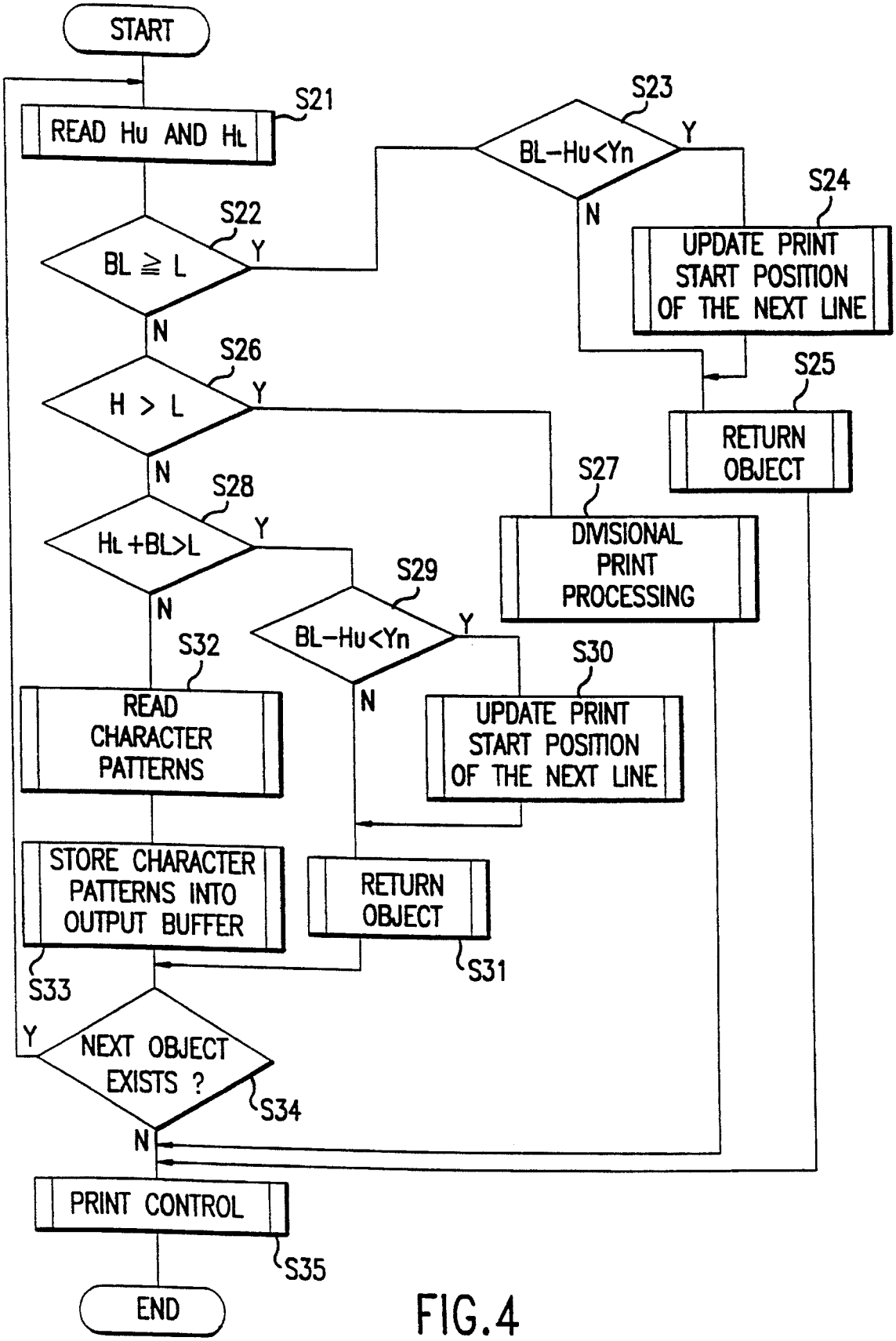
FIG. 4 is a flowchart illustrating the processing of comparatively setting print positions to be performed in an output processor shown in FIG. 1.
Figure 5A:
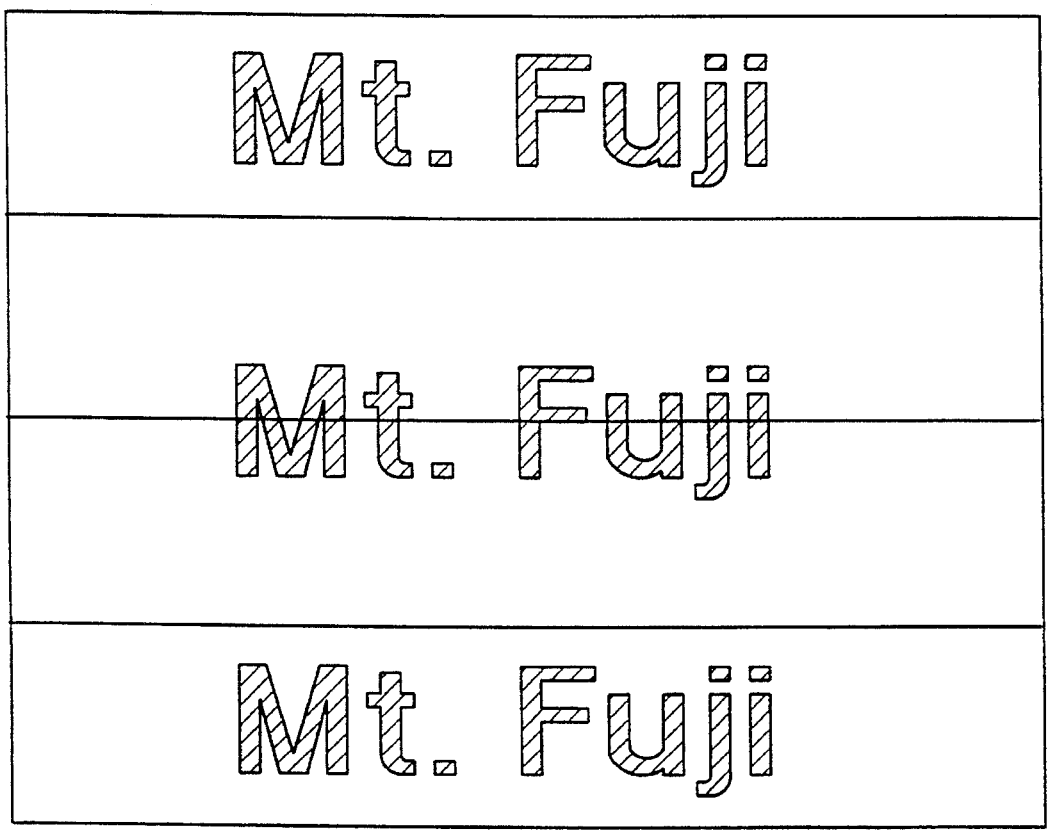
FIG.5A RELATED ART
FIGS. 5A and 5B are diagrams illustrating print examples in the prior art printer.
Figure 5B:
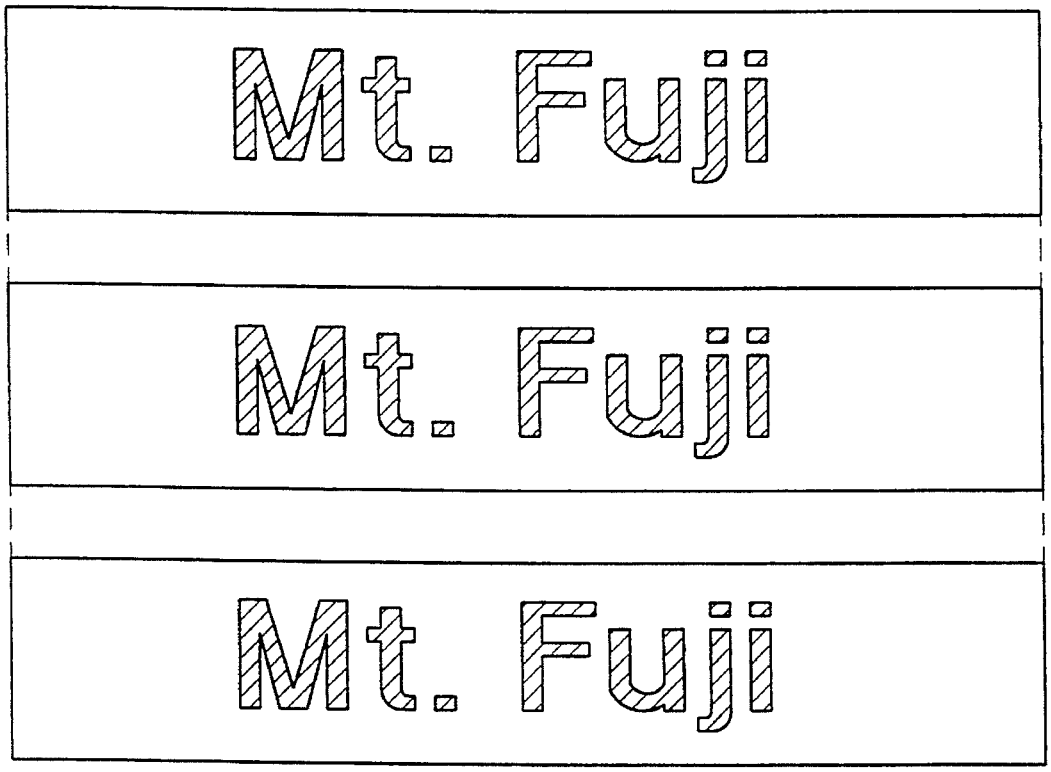
FIG.5B RELATED ART

The processing of comparatively setting the print positions to be carried out in the output processor 9 will now be described with reference to the flowchart shown in FIG. 4.

This processing is performed for the output objects transmitted from the data analyzer 4 to the output processor 9. An absolute position of the reference line for the character string included in each output object on the printing medium is previously designated. Further, an absolute position of the current print area on the printing medium is also previously decided. Accordingly, the distance BL can be calculated from the position of the upper boundary of the current print area and the position of the reference line R1 of the first output object, and the distance $BL_n$ can also be calculated from the position of the upper boundary of the current print area and the position of the reference line R2 of the second output object. In the following description, it is assumed that the distances BL and $BL_n$ have already been calculated.

In S21, the upper height $H_{CU}$ and the lower height $H_{CL}$ of a character in the character string included in the first output object are read from the font ROM 11 according to a character code in the character string, and are set as the upper height $H_U$ and the lower height $H_L$ of the character string, respectively. In the case where the maximums of the values $H_{CU}$ and $H_{CL}$ are required to be calculated, the calculation is performed to set the maximums as the values $H_U$ and $H_L$. In S22, the print width L and the distance BL are compared with each other. If the distance BL is equal to or greater than the print width L (Yes in S22), it is determined that the reference line R1 lies outside the current print area. Accordingly, it is determined that the first output object should not be printed in the current print area, but it should be processed in the next print area or the subsequent print areas. Then, the program proceeds to S23. In S23, the distance $Y_n$ from the upper boundary of the current print area to the upper boundary of the next print area is compared with the distance $(BL-H_U)$ from the upper boundary of the current print area to the uppermost end of the character string. If the distance $(BL-H_U)$ is equal to or greater than the distance $Y_n$ (No in S23), it is determined that the uppermost end of the character string in the second output object is to be printed at a position equal to or higher than the uppermost end of the character string in the first output object currently processed. In this case, the feed quantity of the printing medium becomes the distance $Y_n$. Then, the program proceeds to S25, in which the output objects are returned to the output processor 9 as unprocessed objects. If the distance $(BL-H_U)$ is smaller than the distance $Y_n$ (Yes in S23), it is determined that the uppermost end of the character string in the first output object currently processed is to be printed at a position higher than the uppermost end of the character string in the second output object. Accordingly, the feed quantity of the printing medium must be set to the distance $(BL-H_U)$. Then, the program proceeds to S24, in which the distance $Y_n$ is updated to the distance $(BL-H_U)$, and then proceeds to S25, in which the output objects are returned to the output processor 9 as unprocessed objects.

If the distance BL is smaller than the print width L (No in S22), it is determined that the reference line R1 lies inside the current print area. Then, the program proceeds to S26, in which the full height H and the print width L are compared with each other. If the full height H is greater than the print width L (Yes in S26), it is determined that the character string cannot be fully admitted within the current print area. Then, the program proceeds to S27, in which the processing for divisional printing is performed. If the full height H is equal to or smaller than the print width L (No in S26), the program proceeds to S28, in which the sum of the lower height $H_L$ and the distance BL is compared with the print width L to determine whether or not all the characters in the character string can be admitted within the current print area. If the sum $(H_L+BL)$ is greater than the print width L (Yes in S28), i.e., the lowermost end of the character string is beyond the lower boundary of the current print area, the program proceeds to S29, in which the distance $(BL-H_U)$ is compared with the distance $Y_n$. If the distance $(BL-H_U)$ is smaller than the distance $Y_n$ (Yes in S29), the distance $Y_n$ is updated to the distance $(BL-H_U)$, and the program then proceeds to S31. If the distance $(BL-H_U)$ is equal to or greater than the distance $Y_n$ (No in S29), the program proceeds to S31. In S31, the first output object currently processed is returned to the output processor 9 as an unprocessed object. Then, the program proceeds to S34. The processing in S29 to S31 is similar to that in S23 to S25 mentioned previously.

If the sum $(H_L+BL)$ is equal to or smaller than the print width L (No in S28), it is determined that the character string can be fully admitted within the current print area. Then, the program proceeds to S32, in which character patterns corresponding to the characters in the character string are read from the font ROM 11. Then, in S33, the character patterns thus read are stored into the output buffer 12 at given locations. Thus, the first output object is converted into bit map data by the processing in S32 and S33. Then, the program proceeds to S34, in which it is determined whether or not the next output object exists. If the next output object exists (Yes in S34), the program returns to S21 to repeat the above series of processing. If all the output objects in the current print area are processed to be converted into bit map data (No in S34), the program proceeds to S35, in which print control is performed to effect printing of the bit map data in the current print area of one line.

As an example, it is considered to carry out printing of the output objects as shown in FIG. 3. First, the character string "Japan" included in the first output object is processed. In this case, the distance BL is smaller than the print width L, and the full height H is smaller than the print width L. Furthermore, the sum of the lower height $H_L$ and the distance BL is smaller than the print width L. Therefore, the program proceeds through S21, S22, S26 and S28 to S32 and S33, in which the character string "Japan" is converted into bit map data, which is in turn stored into the output buffer 12. Then, since the next output object including the character string "USA" exists, the processing is similarly repeated from S21. In S22, the distance $BL_n$ is greater than the print width L. Therefore, the program proceeds to S23. In the second output object, the distance $(BL_n-H_U)$ is equal to the distance $Y_n$. Therefore, the distance $Y_n$ is not updated, but the program proceeds directly to S25. In S25, the second output object including the character string "USA" is returned to the output processor 9, and it will be subsequently processed. Thus, the character string "Japan" is converted into bit map data, and the character string "USA" is not converted into bit map data in the current processing. Then, in S35, the character string "Japan" converted into the bit map data is printed on a printing medium. Thereafter, the printing medium is fed by the distance $Y_n$ to start the processing for the next print area. In the processing for the next print area, the second output object including the character string "USA" is first processed.

With use of the dot matrix printer according to the present invention, a print quality can be improved although the number of scans is increased in printing character strings as compared with the prior art printer wherein printing is carried out per a fixed width to cause the occurrence of a cut in printed characters. Accordingly, if a switch or a command for effecting a high-quality mode where a high print quality is preferred rather than a high print speed, a user may preferentially select either the high print quality or the high print speed, thus enabling a print mode to be widely selected.

Figure 6A:
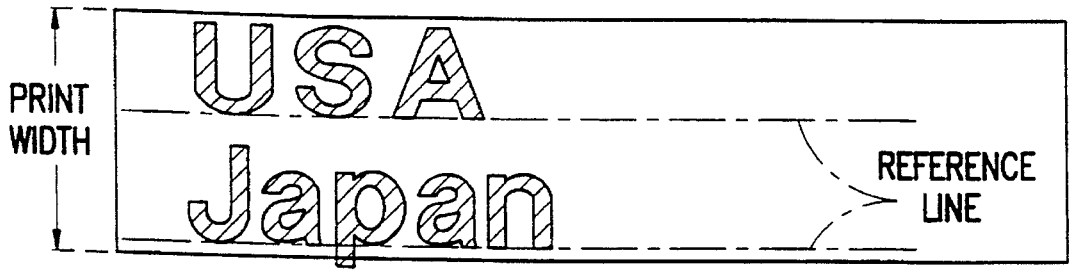
FIG.6A RELATED ART
FIGS. 6A to 6D are diagrams illustrating other print examples in the prior art printer.
Figure 6B:
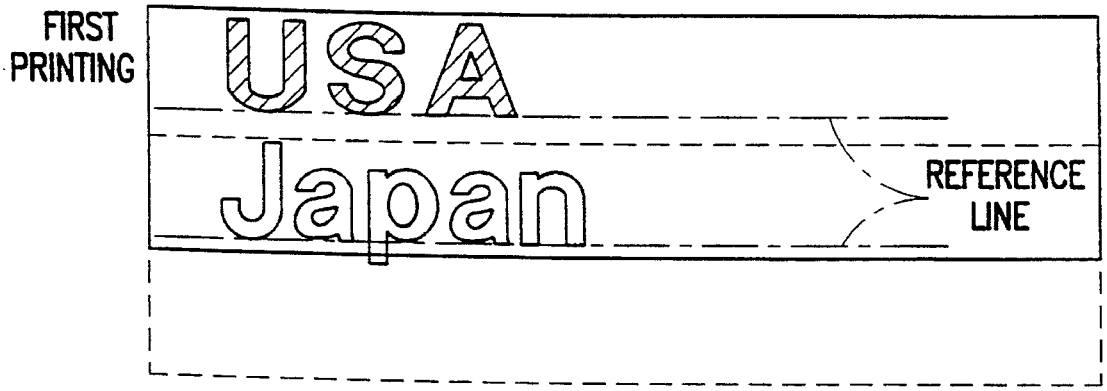
FIG.6B RELATED ART
Figure 6C:
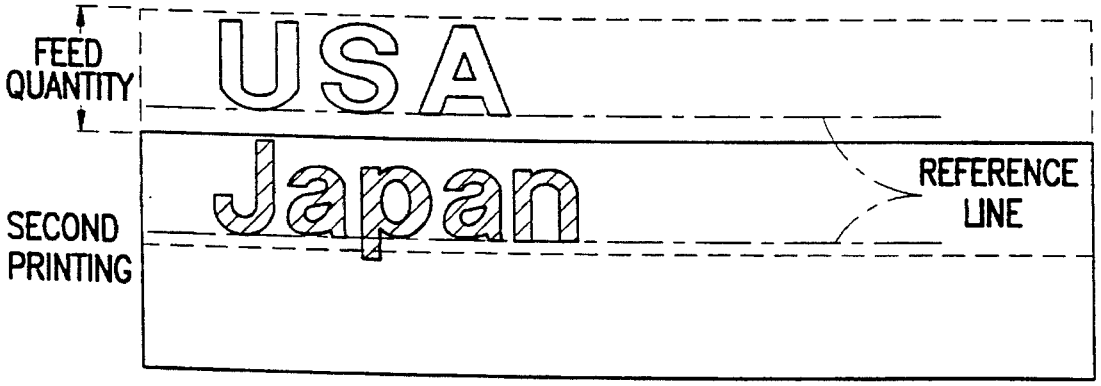
FIG.6C RELATED ART
Figure 6D:
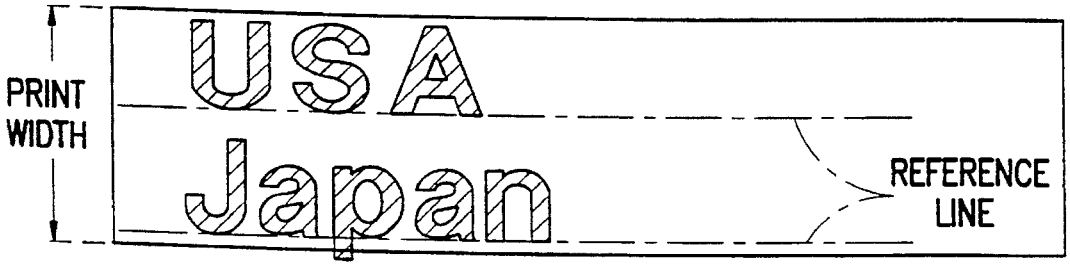
FIG.6D RELATED ART
Figure 7A:
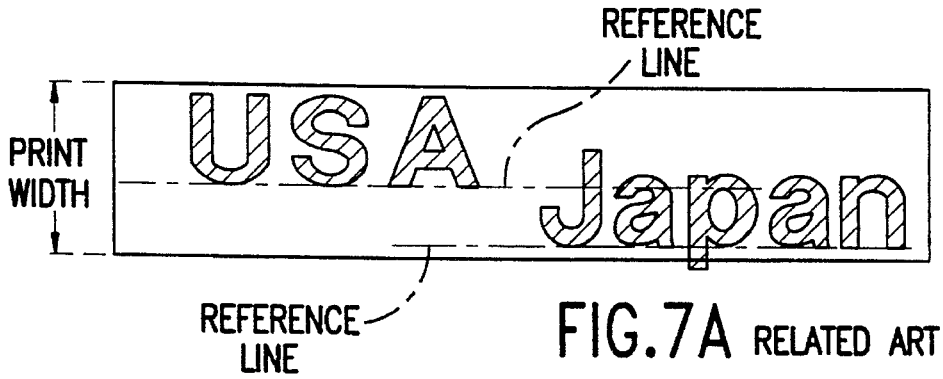
FIG.7A RELATED ART
FIGS. 7A to 7D are diagrams illustrating still other print examples in the prior art printer.
Figure 7B:
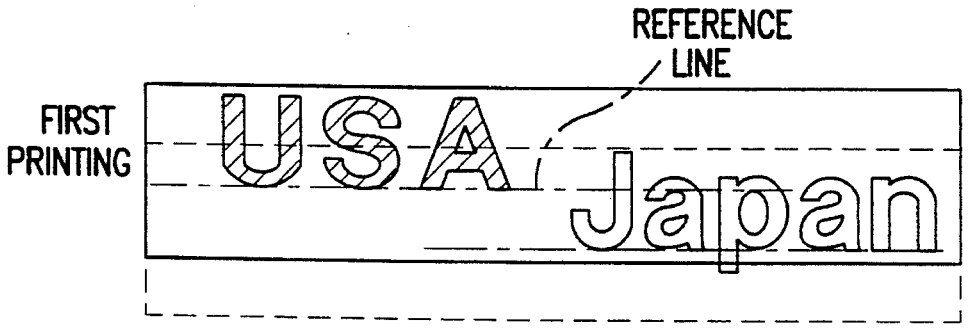
FIG.7B RELATED ART
Figure 7C:
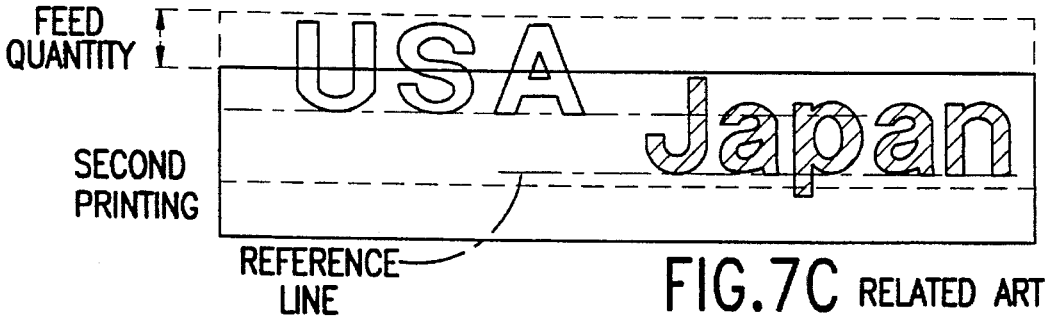
FIG.7C RELATED ART
Figure 7D:
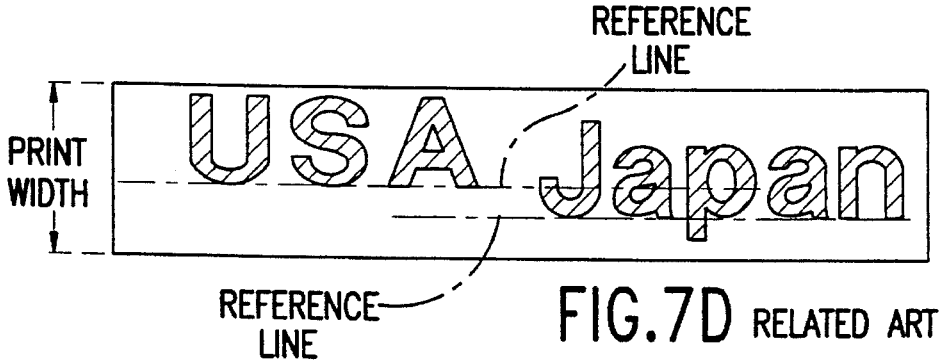
FIG.7D RELATED ART

As another example, it is considered that character strings in two output objects are admitted in one print area as shown in FIGS. 6D and 7D. In this case, the character string "USA" included in the first output object is processed in the order of S21, S22, S26, S28, S32 and S33. In this processing, the character string "USA" is converted into bit map data, which is in turn stored into the output buffer 12. Then, it is determined in S34 that the next output object exists, and the program returns to S21. Then, the character string "Japan" in the second output object is also processed in the order to S21, S22, S26, S28, S32 and S33. In this processing, the character string "Japan" is converted into bit map data, which is in turn stored into the output buffer 12. Thereafter, in S35, both the character strings "USA" and "Japan" are printed in one print area on the printing medium by once scanning the print head 13.

Thus, in comparison with the prior art printer where printing is carried out per print line, a plurality of character strings arranged along different reference lines and admitted in one print area can be printed by a single scan of the print head according to the present invention.

Although the above description of the preferred embodiment has been applied to English letters, the present invention may, of course, applied to kanji, symbols, etc.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A dot matrix printer for effecting printing on a printing medium per a width of a print head according to print data received, comprising:

moving means for relatively moving said printing medium and said print head;

output processing means for preventing division printing and enabling printing of multiple vertically offset character strings in a single printing operation by obtaining the numbers of effective dots of character patterns in a first character string with respect to a first character string reference line, designating a print position of a font of said first character string according to information of said font and information of said first character string reference line, comparing the numbers of effective dots with the numbers of printable dots of said print head, determining whether a second character string and said first character string fit together within the width of said print head if a maximum value of the numbers of effective dots of a sum of said first and second character strings is smaller than the width of said print head, and setting a print position of said first and second character strings that fit together within the width of said print head;

control means for controlling said moving means and said output processing means so that said first and second character strings are output from said output processing means to said print head and that said printing medium and said print head are relatively moved to effect printing of said character strings; and updating means for updating a print start line position of said second character string if the second character string and said first character string do not fit together within the width of said print head so that said second character string is printed in a consecutive scan of said print head while said first character string is output from said output processing means to said print head.

2. The dot matrix printer as defined in claim 1, wherein said moving means comprises a feed motor driver for feeding said printing medium relative to said print head and a carriage driver for moving said print head relative to said printing medium.

3. The dot matrix printer as defined in claim 1, wherein said output processing means comprises means for comparing a distance from an upper boundary of a current print area to said first character string reference line with the width of said print head, means for comparing a full height of said first character string with the width of said print head, means for comparing the sum of a lower height of said first character string from said first character string reference line to a lowermost end of said first character string and the distance from the upper boundary of said current print area to said first character string reference line with the width of said print head, and means for comparing a distance measured by subtracting an upper height of said first character string from the distance from the upper boundary of said current print area to said first character string reference line with a distance from the upper boundary of said current print area to an uppermost end of said second character string in a next print area.

4. The dot matrix printer as defined in claim 3, further comprising a ROM for previously storing said information of said font of said first character string and said information of said first and second character string reference lines, and a buffer for temporarily storing said first and second character strings output from said output processing means.

5. The dot matrix printer as defined in claim 4, wherein said output processing means further comprises means for reading said information of font of said first character string from said ROM, means for writing said first character string in said current print area into said buffer, and means for updating the distance from the upper boundary of said current print area to the uppermost end of said second character string in said next print area.

6. A method of setting a print positions of character strings, comprising the steps of:

obtaining numbers of effective dots of character patterns in a first character string with respect to a first character string reference line;

designating a print position of a font of said first character string according to information of said font and information of said first character string reference line, said designating step including the steps of:

comparing a distance from an upper boundary of a current print area to said first character string reference line for said first character string with a width of a print head;

comparing a full height of said first character string with the width of said print head when the distance from the upper boundary of said current print area to said first character string reference line is smaller than the width of said print head;

comparing the sum of a lower height of said first character string from said first character string reference line to a lowermost end of said first character string and the distance from the upper boundary of said current print area to said first character string reference line with the width of said print head when the full height of said first character string is not greater than the width of said print head;

converting said first character string into bit map data to be printed when the sum of a lower height of said first character string from said first character string reference line to a lowermost end of said first character string and the distance from the upper boundary of said current print area to said first character string reference line is less than the width of said print head;

comparing the numbers of effective dots with the numbers of printable dots of said print head;

determining whether a second character string and said first character string fit together within the width of said print head if a maximum value of the numbers of effective dots of a sum of said first and second character strings is smaller than the width of said print head;

setting a print position of said first and second character strings that fit together within the width of said print head; and updating a print start line position of said second character string if the second character string and said first character string do not fit together within the width of said print head so that said second character string is printed in a consecutive scan of said print head while said first character string is output from said output processing means to said print head.

* * * * *